US009205974B1

(12) United States Patent
Edwards

(10) Patent No.: US 9,205,974 B1
(45) Date of Patent: Dec. 8, 2015

(54) BUNDT CAKE CARRIER

(71) Applicant: Janice M. Edwards, Texas City, TX (US)

(72) Inventor: Janice M. Edwards, Texas City, TX (US)

( * ) Notice: Subject to any disclaimer, the term of this patent is extended or adjusted under 35 U.S.C. 154(b) by 381 days.

(21) Appl. No.: 13/888,521

(22) Filed: May 7, 2013

(51) Int. Cl.
*B65D 85/02* (2006.01)
*B65D 85/60* (2006.01)
*B65D 21/02* (2006.01)

(52) U.S. Cl.
CPC ..... *B65D 85/60* (2013.01); *B65D 21/0222* (2013.01)

(58) Field of Classification Search
CPC ..... B65D 21/0222; B65D 85/60
USPC ..... 206/303, 493, 551; 99/426, 428, 439, 99/442; 220/315, 318, 324, 326, 675; 426/115, 124, 128; D7/610
See application file for complete search history.

(56) References Cited

U.S. PATENT DOCUMENTS 4,375,862 A * 3/1983 Kurinsky et al. ..... 220/293
5,676,252 A * 10/1997 Lillelund et al. ..... 206/551
5,685,453 A * 11/1997 Goins et al. ..... 220/675
D478,246 S 8/2003 Villano et al.
D479,952 S * 9/2003 Zimmerman ..... D7/610
6,938,540 B2 9/2005 Morgan
D513,588 S 1/2006 Vovan
D522,813 S * 6/2006 Swinford et al. ..... D7/610
7,100,498 B2 9/2006 Morgan
D530,563 S 10/2006 Henry et al.
7,178,668 B2 * 2/2007 Vovan ..... 206/303
2008/0105681 A1 * 5/2008 Vovan ..... 220/288
2010/0200583 A1 * 8/2010 Curtin et al. ..... 220/315
2012/0223087 A1 * 9/2012 Wang ..... 220/592.2
2012/0248116 A1 * 10/2012 Smyers et al. ..... 220/324
2013/0071531 A1 * 3/2013 Dagan et al. ..... 220/810
2015/0136786 A1 * 5/2015 Lonner et al. ..... 220/324

* cited by examiner

*Primary Examiner* — Luan K Bui
(74) *Attorney, Agent, or Firm* — Robert C. Montgomery; Montgomery Patent Design, LP

(57) ABSTRACT

A carrier for a Bundt-cake-style food product includes a lid assembly and a base assembly that includes a plate and a hub that extends upward from the plate. The lid assembly includes downward extending clip fasteners that are located around the lower perimeter of the lid assembly. The clips each have a protrusion that snap fits into a groove around the perimeter of the base assembly. The snap fit securely fastens the lid assembly to the base assembly. The lid assembly also includes a carrying handle, a hub receiver that receives the hub when the lid assembly is attached to the base assembly, and a plurality of stabilizing ribs.

20 Claims, 3 Drawing Sheets

BUNDT CAKE CARRIER

RELATED APPLICATIONS

There are no current co-pending applications.

FIELD OF THE INVENTION

The disclosed subject matter is directed toward cake carriers. More particularly, the present invention is directed toward carriers for Bundt-style cakes.

BACKGROUND OF THE INVENTION

Preparing food is a time consuming but very important task. The effort that goes into preparing food can be immense. In fact, food and its preparation are major components of the economic activity of the United States.

While preparing food may be time consuming, without proper storage all that work may be wasted. Poorly stored or poorly protected food may become detrimental to health and such can dramatically reduce the attractiveness and desirability of a food product. Contamination such as bacteria, dirt, dust, animal hair and many other types of debris represent problems that can be successfully avoided by proper food protection. Compounding the problem of protecting food is the need to transport food from one location to another. While protecting all food is important, some foodstuffs such as cakes and pies are readily subject to physical damage which can dramatically reduce their value and desirability.

Large foodstuffs such as Bundt-style cakes are particularly difficult to properly store and transport. The widely used and available food storage bags are simply unsuitable for a Bundt-style cake. Bundt-style cake storage and transport requires a large, rigid horizontal support and vertical walls that do not contact the cake. In addition, clear containers are required to properly present the cake. Typically the required horizontal support is provided by a plate of some type. However, providing a protective container that attractively presents the contained Bundt-style cake is problematic. Compounding the problem is that Bundt-style cakes can be easily damaged simply by placing them into or removing them from a box.

Therefore, a storage and transportation container suitable for use with Bundt-style cakes and similarly shaped items would be beneficial. Even more beneficial would be storage and transportation containers for Bundt-style cakes and similarly shaped items that attractively present the contained item. Preferably such storage and transportation containers would be easy to use and would enable easy storage and removal of enclosed Bundt-style cakes or similarly shaped items in a manner that the risk of damage is reduced or avoided.

SUMMARY OF THE INVENTION

The principles of the present invention provide for storage and transportation containers suitable for use with Bundt-style cakes and similarly shaped items. Containers in accord with the present invention attractively present their contained items, are easy to use, and enable easy storage, transportation, and removal of Bundt-style cakes or similarly shaped items in a manner that reduces the risk of damage.

A cake carrier that is in accord with the present invention includes a base assembly having a cylindrical plate with a substantially circular top and an annular locking groove around its perimeter. A centrally-located cylindrical hub extends upward from the top while a base lip horizontally extends around the bottom of the plate. A lid assembly having an open-bottom dome structure that defines an interior and an exterior has a handle that is attached to the exterior. A lower lip extends around the bottom of the dome structure. Three (3) clips are attached to the exterior; each clip includes a locking protrusion and extends below the lower lip. The locking protrusion is configured to snap fit into the locking groove.

In practice the lid assembly may be made from a transparent material such as molded plastic. The clips may be attached to the exterior by rivets or chemical bonding. Preferably the hub is integral with the plate while the locking groove has a channel-shaped cross-section. The snap fit is such that the cake carrier can carry a Bundt-style cake by its handle. The locking protrusions can be removed from the locking groove by downward pressure on the lower lip near a clip and upward pressure on the handle. In practice the lid assembly may further include a hub receiver that extends downward from the interior. The hub receiver is then configured to receive the hub when the lid assembly is attached to the base assembly. The dome structure may also include a plurality of integrally-molded ribs.

An alternative cake carrier that is in accord with the present invention includes a base assembly having a plate with a substantially flat top and an annular locking groove around its perimeter. A cylindrical hub extends upward from the top while a base lip horizontally extends around the bottom of the plate. A lid assembly having an open-bottom dome structure that defines an interior and an exterior has a handle that is attached to its exterior. A lower lip extends around the bottom of the dome structure. Three (3) clips are attached to the exterior; each clip includes a locking protrusion and extends below the lower lip. The locking protrusion is configured to snap fit into the locking groove with a positive locking bias.

In practice the lid assembly is a transparent plastic. The clips may be attached to the exterior by rivets or chemical bonding. Preferably the hub is integral with the plate while the locking groove has a channel-shaped cross-section. The snap fit is such that the cake carrier can carry a Bundt-style cake by its handle. In practice the lid assembly may further include a hub receiver that extends downward from the interior. The hub receiver is then configured to receive the hub when the lid assembly is attached to the base assembly.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
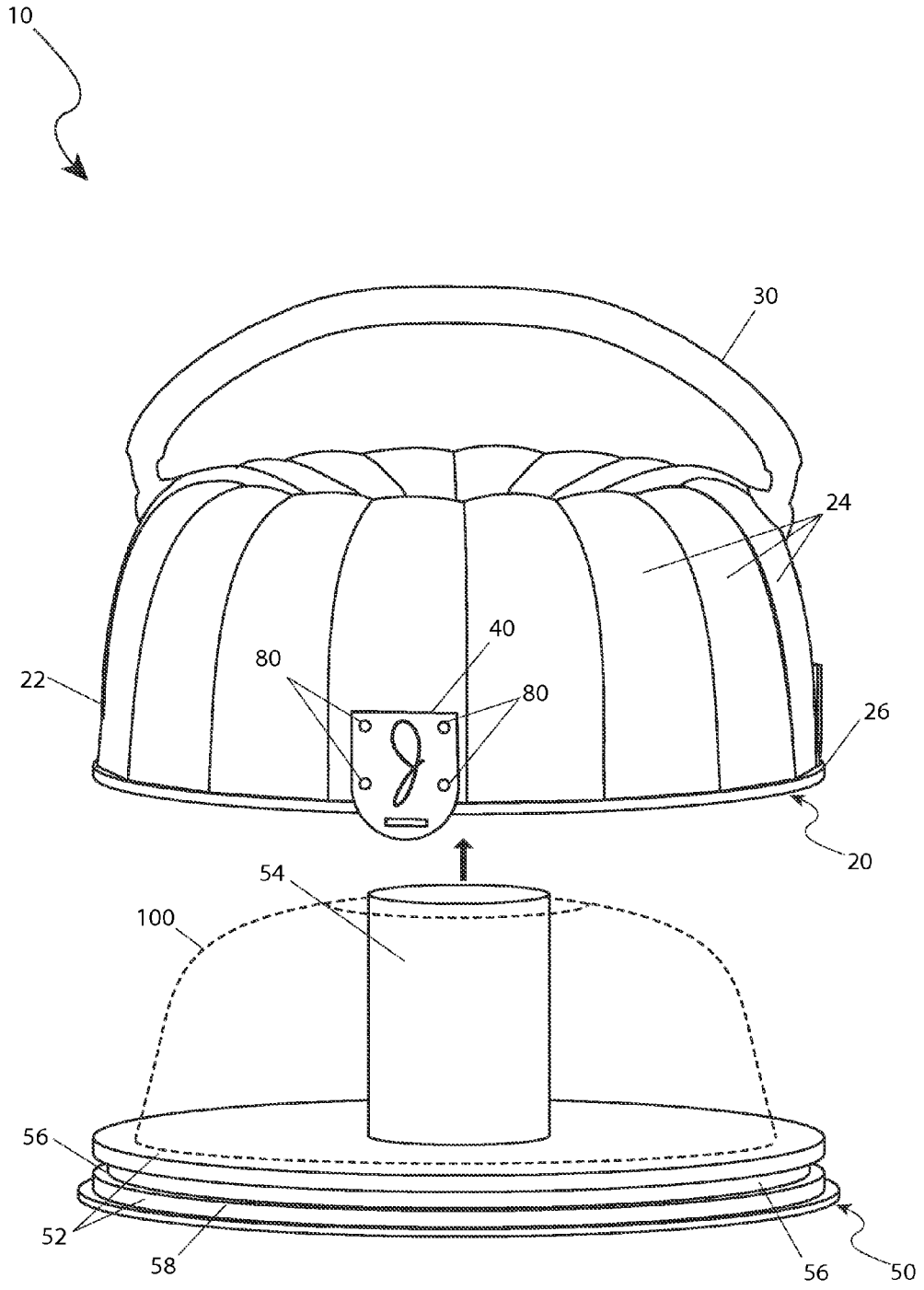
FIG. 1 is an exploded view of a Bundt cake carrier 10 that is in accord with a preferred embodiment of the present invention.

10 cake carrier
20 lid assembly
22 dome structure
24 rib feature
26 first lip
28 upper panel
30 handle
32 hub receiving feature

34 socket
40 clip
42 locking protrusion
50 base assembly
52 plate
54 hub
56 locking groove
58 second lip
80 fastener
100 cake

DETAILED DESCRIPTION OF THE PREFERRED EMBODIMENT

Figure 2:
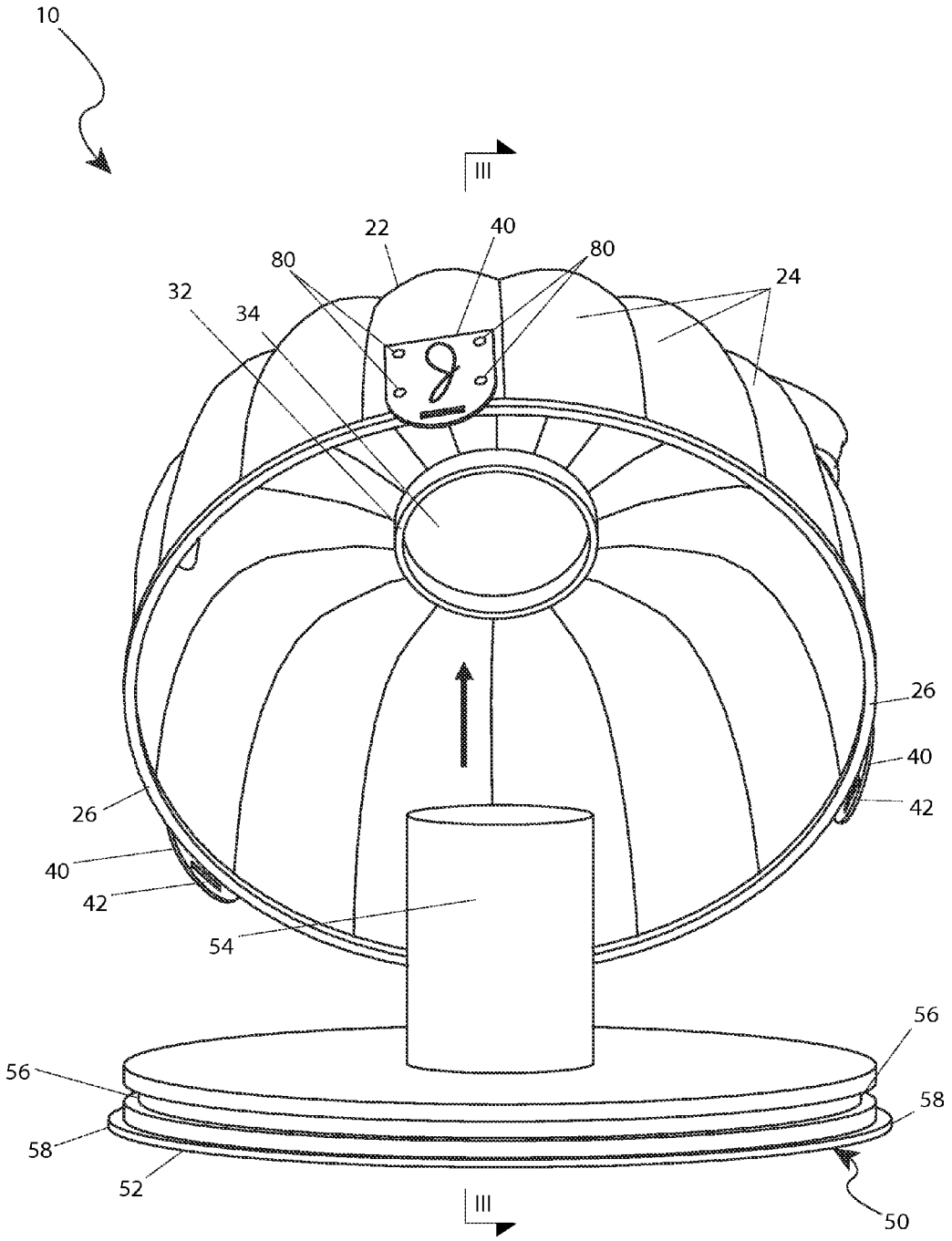
FIG. 2 is a bottom perspective view of a lid assembly 20 of the cake carrier 10 shown in FIG. 1; and, FIG. 3 is a section view of the cake carrier 10 taken along section line III-III of FIG. 2.
Figure 3:
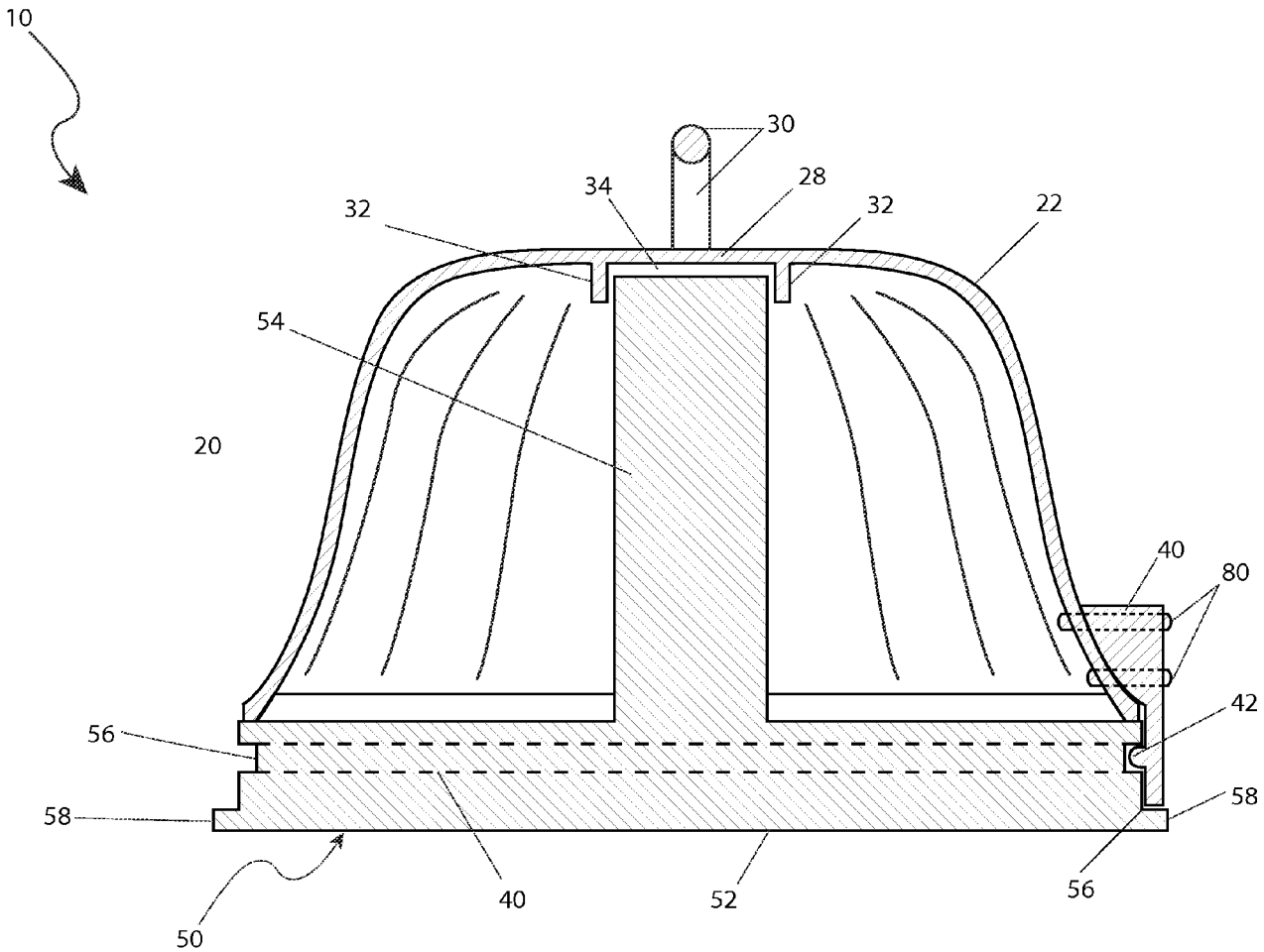

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

FIGS. 1 and 2 provide exploded and bottom perspective views of a cake carrier 10 that is in accord with the present invention. The present invention describes a Bundt-style cake 10, which provides a means for containing, attractively presenting, and protectively transporting a Bundt-style cake 100 or similarly shaped food product.

As shown, the cake carrier 10 comprises a base assembly 50 and a lid assembly 20 with features for removably attaching the lid assembly 20 to base assembly 50. The cake carrier 10 provides a protective enclosure for a Bundt-style cake 100 or similarly shaped food product. The cake carrier 10 is particularly useful when transporting a cake. It should be understood that the cake carrier 10 may be introduced in a variety of overall sizes which correspond to various sized cakes 100. Furthermore, the cake carrier 10 is beneficially molded from transparent or opaque plastic materials.

The lid assembly 20 includes an open-bottom dome structure 22 having a plurality of integrally-molded ribs 24 radially arranged along side surfaces. The ribs 24 extend from a circular, flat upper panel 28 (reference FIG. 3). The lid assembly 20 further includes an integrally-molded, ergonomic-design handle 30 and a bottom decorative first lip 26. The handle 30 is an arcuate-shaped member which spans across the flat upper panel 28, while the decorative first lip 26 which extends horizontally outward from the lower perimeter.

Still referring to FIGS. 1 and 2, the lid assembly 20 also includes three equally-spaced clips 40. The clips 40 provide a secure attachment of the lid assembly 20 to the base 50. The clips 40 which are affixed along the first lip 26 using a plurality of fasteners 80 such as rivets or chemical bonding or a similar construction technique. The clips 40 descend past the bottom of the first lip 26 to enable engagement with a subjacent annular locking groove 56 of the base assembly 50 (also see FIG. 3).

The base assembly 50 comprises a low-profile cylindrical plate 52 having flat, circular top and bottom surfaces that are dimensioned to support the Bundt-style cake 100. The plate 52 also includes an integral cylindrical hub 54 that extends upward from the center of the plate 52. The plate 52 also includes a horizontally extending second lip 58 around the lower perimeter and the previously mentioned locking groove 56 with a channel-shaped cross-section which provides secure engagement with the lid assembly 20 (see FIG. 3). As noted the locking groove 56 is sized to provide a secure removable engagement of respective locking protrusion 42 of the clips 40.

The hub 54 is dimensioned to fit loosely within the center opening of a standard Bundt-style cake 100. The hub is dimensioned both horizontally and vertically to act as a stabilizer for the Bundt-style cake 100 within the cake carrier 10 while carrying and transporting.

FIG. 3 presents a section view of the cake carrier 10 taken along section line III-III of FIG. 2. The lid assembly 20 clips 40 securely engage the base assembly 50 to the lid assembly 20 via inserting engagement of locking protrusions 42 into the locking groove 56. The locking protrusions 42 are configured to snap into the locking groove 56 to provide such a positive locking bias that the locking protrusions 42 and the locking groove 56 can support the Bundt-style cake as it is being moved. This enables carrying the Bundt-style cake 100 using only the handle 30.

To access the Bundt-style cake 100 the lid assembly 20 may be removed by pressing down on the first lip 58 of the base assembly 50 near a clip 40 while pulling firmly upward on the handle 30. This releases the locking protrusion 42 from the locking groove 56. This action can be repeated as required at other clips 40 to enable removing the lid assembly 20 from the base assembly 50. The Bundt-style cake 100 can then be lifted away from the hub 54.

Still referring to FIG. 3, when the lid assembly 20 is placed on the base assembly 50 the hub 54 extends upward and inserts into and engages a center socket 34 of a hub receiver 32 which is molded into the bottom side of the upper panel 28 of the lid assembly 20. The hub 54 is supported by the hub receiver in stabilizing the Bundt-style cake 100.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the cake carrier 10, it would be installed as indicated in FIG. 1.

The method of utilizing the cake carrier 10 may be achieved by performing the following steps: procuring a model of the cake carrier 10 having a desired size and internal space which corresponds to a particularly sized Bundt-style cake 100 to be contained within; placing the center opening of the Bundt-style cake 100 over the hub 54 until the Bundt-style cake 100 rests upon the plate 52 of the base assembly 50; placing the lid assembly 20 downward upon the base assembly 50 being careful to engage the hub 54 to the hub receiver 32; securing the lid assembly 20 to the base assembly 50 by engaging the locking protrusion 42 of the clips 40 with the locking groove 56 of the base assembly 50 until obtaining snapping; grasping and lifting the handle 30 and transporting the Bundt-style cake 100 to a desired destination; placing the cake carrier 10 and its contained Bundt-style cake 100 onto a flat surface such as a table or the like; removing the lid assembly 20 by manually pressing down upon the first lip 58 of the base assembly 50 near a clip 40 while pulling firmly upward on the handle 30 to release a locking protrusion 42 from the locking groove 56; if required, manually pressing down upon the first lip 58 of the base assembly 50 near another clip 40 while pulling firmly upward on the handle 30 to release the locking protrusion 42 from the locking groove 56; lifting the lid assembly 20 gently upward to uncover the Bundt-style cake 100; and, if desired, removing the Bundt-style cake 100 from the hub 54; and benefiting from a protective and portable means to contain and transport a Bundt-style cake afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A cake carrier, comprising:

a base assembly having a cylindrical plate with a substantially circular top, an annular locking groove around the perimeter of said plate, and a centrally located cylindrical hub that extends upward from said top, said base assembly further including a horizontally extending base lip around the bottom of said plate; and, a lid assembly having an open-bottom dome structure defining an interior and an exterior, a handle attached to said exterior, a lower lip around the bottom of said dome structure, and three clips attached to said exterior, each clip extending below said lower lip and having a locking protrusion;

wherein each locking protrusion is configured to snap fit into said locking groove.

2. The cake carrier according to claim 1, wherein said lid assembly is comprised of transparent material.

3. The cake carrier according to claim 2, wherein said lid assembly is molded plastic.

4. The cake carrier according to claim 1, wherein said clips are attached to said lid assembly by rivets.

5. The cake carrier according to claim 1, wherein said clips are attached to said lid assembly by chemical bonding.

6. The cake carrier according to claim 1, wherein said hub is integral with said plate.

7. The cake carrier according to claim 1, wherein locking groove has a channel-shaped cross-section.

8. The cake carrier according to claim 7, wherein said snap fit enables said cake carrier to carry a Bundt cake by said handle.

9. The cake carrier according to claim 8, wherein said locking protrusion can be removed from said locking groove by downward pressure on said lower lip near a clip and upward pressure on said handle.

10. The cake carrier according to claim 1, wherein said lid assembly further includes a hub receiver that extends downward from said interior and is configured to receive said hub when said lid assembly is attached to said base assembly.

11. The cake carrier according to claim 10, wherein dome structure includes a plurality of integrally-molded ribs.

12. A cake carrier, comprising:

a base assembly having a plate with a substantially flat top, an annular locking groove around the perimeter of said plate, and a cylindrical hub that extends upward from said plate, said base assembly further including a horizontally extending base lip; and, a lid assembly with open-bottom dome structure that defines an interior and an exterior, a handle attached to said exterior, a lower lip around the bottom of said dome structure, and three clips attached to said exterior, each of said three clips extending below said lower lip and having a locking protrusion;

wherein each locking protrusion is configured to snap into said locking groove with a positive locking bias.

13. The cake carrier according to claim 12, wherein said lid assembly is transparent.

14. The cake carrier according to claim 13, wherein said lid assembly is plastic.

15. The cake carrier according to claim 12, wherein said clips are attached to said lid assembly by rivets.

16. The cake carrier according to claim 12, wherein said clips are attached to said lid assembly by chemical bonding.

17. The cake carrier according to claim 12, wherein said hub is integral with said plate.

18. The cake carrier according to claim 12, wherein locking groove has a channel-shaped cross-section.

19. The cake carrier according to claim 12, wherein said positive locking bias enables said cake carrier to carry a Bundt cake by said handle.

20. The cake carrier according to claim 12, wherein said lid assembly further includes a hub receiver that receives said hub when said lid assembly is attached to said base assembly.

* * * * *